US011682847B2

(12) United States Patent
Chen et al.

(10) Patent No.: US 11,682,847 B2
(45) Date of Patent: Jun. 20, 2023

(54) ANTENNA ARRAY DEVICE AND ANTENNA UNIT THEREOF

(71) Applicant: WISTRON NEWEB CORPORATION, Hsinchu (TW)

(72) Inventors: Shih-Hong Chen, Hsinchu (TW); Chien-Ming Peng, Hsinchu (TW); Chao-Chun Lin, Hsinchu (TW); Yu-Fu Kuo, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 79 days.

(21) Appl. No.: 17/500,985

(22) Filed: Oct. 14, 2021

(65) Prior Publication Data

US 2022/0376405 A1 Nov. 24, 2022

(30) Foreign Application Priority Data

May 19, 2021 (TW) ..... 110117986

(51) Int. Cl.
*H01Q 21/06* (2006.01)
*H01Q 1/42* (2006.01)

(52) U.S. Cl.
CPC ..... *H01Q 21/065* (2013.01); *H01Q 1/42* (2013.01)

(58) Field of Classification Search
CPC ..... H01Q 21/0031; H01Q 21/0065; H01Q 1/1207; H01Q 1/288; H01Q 1/38; H01Q 1/42; H01Q 9/0414
See application file for complete search history.

(56) References Cited

U.S. PATENT DOCUMENTS

| | | | | |
|---|---|---|---|---|
| 6,211,824 | B1 * | 4/2001 | Holden | H01Q 9/0414 343/846 |
| 10,658,758 | B2 * | 5/2020 | Hafenrichter | H01Q 21/061 |
| 11,509,048 | B2 * | 11/2022 | Milroy | H01Q 1/1228 |
| 2003/0067410 | A1 * | 4/2003 | Puzella | H01Q 21/065 343/700 MS |
| 2013/0335292 | A1 | 12/2013 | Hung | |
| 2015/0015453 | A1 * | 1/2015 | Puzella | H05K 1/0206 333/1.1 |
| 2017/0244161 | A1 * | 8/2017 | Hashimoto | H01Q 1/42 |
| 2019/0296428 | A1 * | 9/2019 | Hashimoto | H01Q 21/065 |
| 2022/0239013 | A1 * | 7/2022 | Huang | H01Q 1/288 |
| 2022/0376405 | A1 * | 11/2022 | Chen | H01Q 1/1207 |

* cited by examiner

*Primary Examiner* — Jason Crawford
(74) *Attorney, Agent, or Firm* — McClure, Qualey & Rodack, LLP

(57) ABSTRACT

An antenna array device and an antenna unit thereof are provided. The antenna unit includes an antenna structure and a molding support. The antenna structure includes a substrate and a plurality of patches that are formed on the substrate. The substrate has a plurality of channel holes penetrating there-through. The molding support is integrally formed on the substrate as a single one-piece structure. The molding support has a first stand, a second stand, and a plurality of connection portions that are formed in the channel holes to connect the first stand and the second stand. The first stand and the second stand are formed on two sides of the substrate, respectively.

19 Claims, 17 Drawing Sheets

ANTENNA ARRAY DEVICE AND ANTENNA UNIT THEREOF

CROSS-REFERENCE TO RELATED PATENT APPLICATION

This application claims the benefit of priority to Taiwan Patent Application No. 110117986, filed on May 19, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna, and more particularly to an antenna array device and an antenna unit thereof.

BACKGROUND OF THE DISCLOSURE

A conventional antenna device includes a plurality of antenna units and a plurality of spacers that are provided to separate the antenna units from each other. In other words, any two of the antenna units adjacent to each other are separated from each other by one of the spacers. However, since each of the antenna units of the conventional antenna device needs to be assembled with at least one of the spacers, a production process of the conventional antenna device is prolonged, and an issue of tolerance accumulation easily occurs in the assembling of the antenna units and the spacers.

SUMMARY OF THE DISCLOSURE

In response to the above-referenced technical inadequacies, the present disclosure provides an antenna array device and an antenna unit thereof, so as to effectively improve on the issues associated with conventional antenna devices.

In one aspect, the present disclosure provides an antenna array device, which includes a first housing, a second housing, and an antenna module. The first housing and the second housing are connected to each other so as to jointly define a distribution space. The antenna module is located in the distribution space and includes a first antenna unit, a second antenna unit, and a feeding antenna unit. The first antenna unit includes a first antenna structure and a molding support. The first antenna structure includes a first substrate and a plurality of first patches that are formed on the first substrate. The first substrate has a plurality of channel holes penetrating there-through. The molding support is integrally formed on the first substrate as a single one-piece structure. The molding support has a first stand, a second stand, and a plurality of connection portions that are formed in the channel holes to connect the first stand and the second stand. The first stand and the second stand are respectively formed on two sides of the first substrate, and the first stand faces toward the first housing. The second antenna unit includes a second antenna structure and a spacer. The second antenna structure is located between the second stand and the spacer. The feeding antenna unit is located between the second housing and the spacer, and is configured to couple to the second antenna structure.

In another aspect, the present disclosure provides an antenna unit of an antenna array device, which includes an antenna structure and a molding support. The antenna structure includes a substrate and a plurality of patches that are formed on the substrate. The substrate has a plurality of channel holes penetrating there-through. The molding support is integrally formed on the substrate as a single one-piece structure. The molding support has a first stand, a second stand, and a plurality of connection portions that are formed in the channel holes to connect the first stand and the second stand. The first stand and the second stand are respectively formed on two sides of the substrate.

In yet another aspect, the present disclosure provides an antenna array device, which includes a first housing, a second housing, and an antenna module. The first housing and the second housing are connected to each other so as to jointly define a distribution space. The antenna module is located in the distribution space and includes a first antenna unit, a second antenna unit, and a feeding antenna unit. The first antenna unit includes a first antenna structure and a support. The first antenna structure includes a first substrate and a plurality of first patches that are formed on the first substrate. The first substrate has a plurality of penetrating holes penetrating there-through. The support includes a first stand, a second stand, and a plurality of connection portions that are arranged in the penetrating holes to connect the first stand and the second stand. The first stand and the second stand are respectively disposed on two sides of the first substrate, and the first stand faces toward the first housing. The second antenna unit includes a second antenna structure and a spacer. The second antenna structure is located between the second stand and the spacer. The feeding antenna unit is located between the second housing and the spacer, and is configured to couple to the second antenna structure.

Therefore, the antenna unit (e.g., the first antenna unit) of the present disclosure is provided with the penetrating holes (e.g., the channel holes) that are formed in the substrate (e.g., the first substrate) to receive the connection portions, so that the first stand and the second stand can be firmly formed on the two sides of the substrate (e.g., the first substrate) by the connection portions arranged in the penetrating holes (e.g., the channel holes), thereby reducing a quantity of components to be assembled in the antenna array device. Accordingly, a production process of the antenna array device can be shortened, and tolerance accumulation generated from assembling the components of the antenna array device can be effectively reduced.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
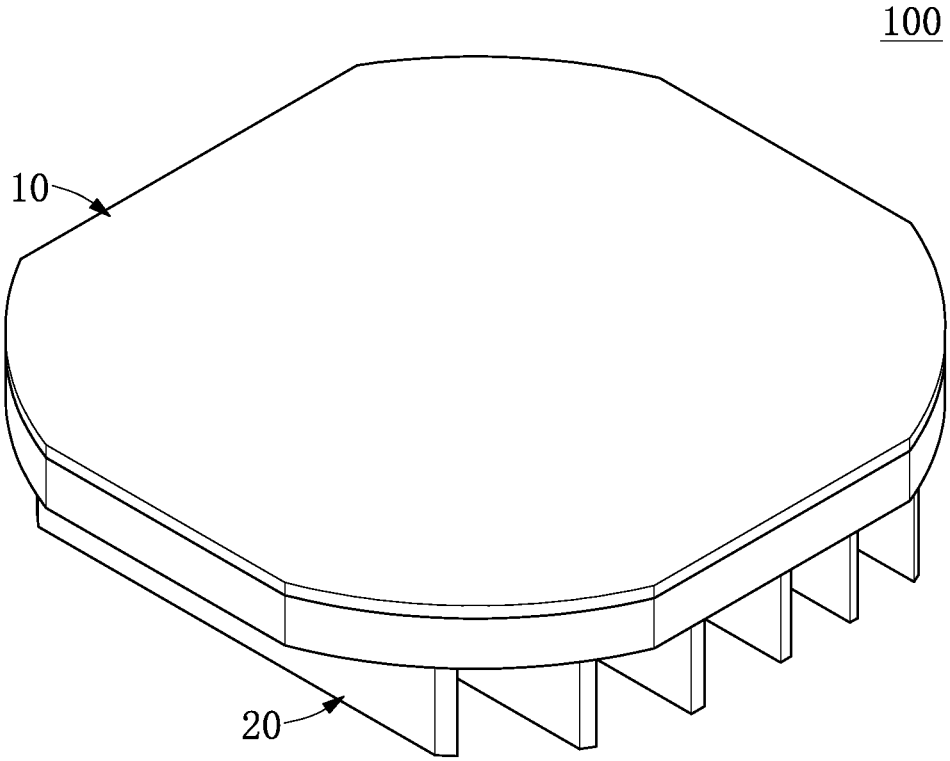
FIG. 1 is a perspective view of an antenna array device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

In addition, the term "connect" used herein refers to a physical connection between two elements, which can be a direct connection or an indirect connection. Moreover, the term "couple to" or "coupling to" used herein refers to two elements being separated and having no physical connection, and an electric field generated by a current of one of the two elements excites that of the other one.

First Embodiment

Figure 2:
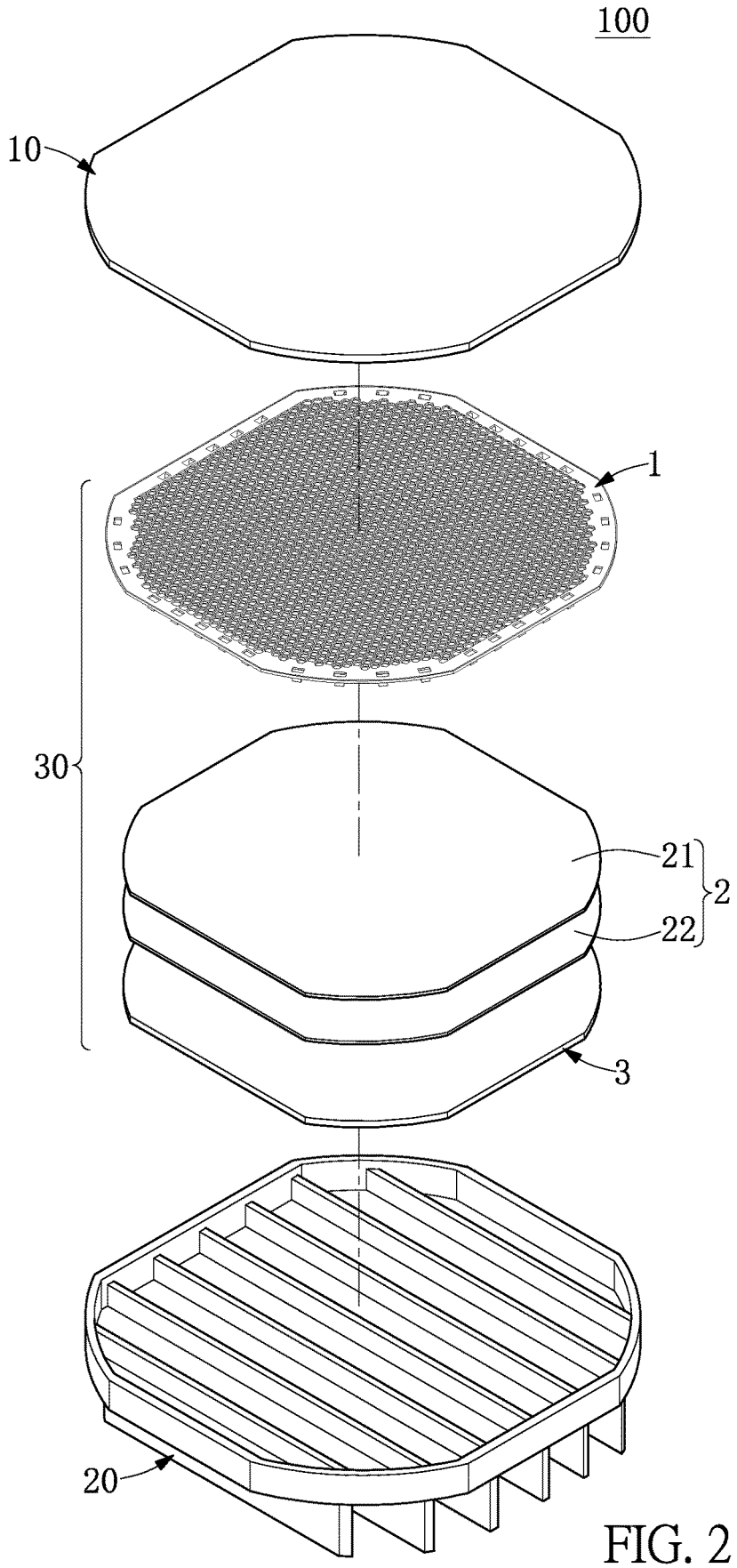
FIG. 2 is an exploded view of FIG. 1.
Figure 3:
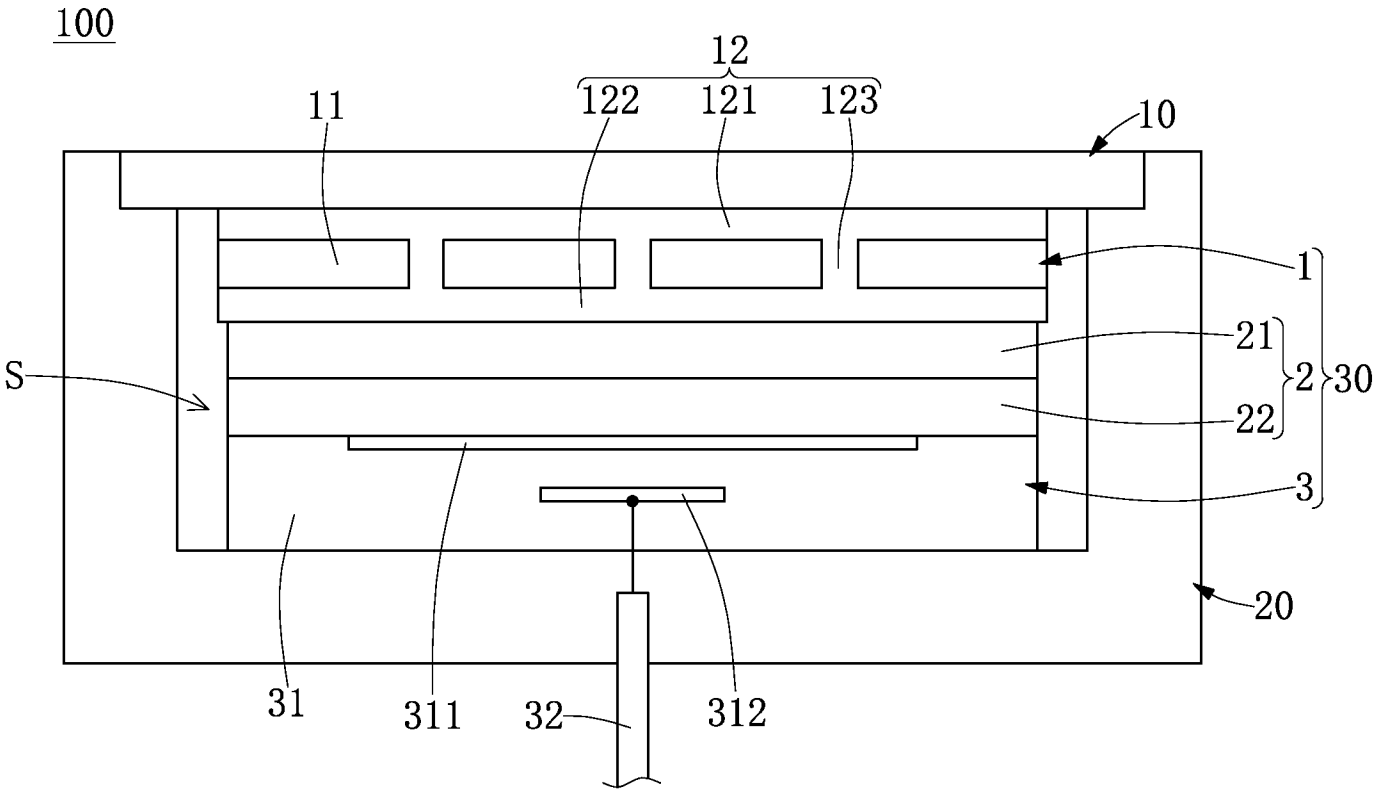
FIG. 3 is a schematic cross-sectional view of FIG. 1.

Referring to FIG. 1 to FIG. 14, a first embodiment of the present disclosure provides an antenna array device 100. As shown in FIG. 1 to FIG. 3, the antenna array device 100 in the present embodiment can be a satellite antenna device that is used to emit and receive signals to and from a satellite, but the present disclosure is not limited thereto. The antenna array device 100 includes a first housing 10, a second housing 20, and an antenna module 30 that is located between the first housing 10 and the second housing 20.

The first housing 10 and the second housing 20 are connected to each other so as to jointly define a distribution space S, and the antenna module 30 is located in the distribution space S. The distribution space S is a substantially enclosed space, and at least one of the first housing 10 and the second housing 20 preferably has a structure arranged in the distribution space S for holding the antenna module 30. However, the specific structure of any one of the first housing 10 and the second housing 20 can be adjusted or changed according to design requirements, and is not limited by the present embodiment.

The antenna module 30 includes a first antenna unit 1, a second antenna unit 2, and a feeding antenna unit 3. The feeding antenna unit 3, the second antenna unit 2, and the first antenna unit 1 in the present embodiment are sequentially stacked on the second housing 20. In other words, the first antenna unit 1 is arranged adjacent to the first housing 10, the feeding antenna unit 3 is disposed on the second housing 20, and the second antenna unit 2 is sandwiched between the first antenna unit 1 and the feeding antenna unit 3.

It should be noted that the first antenna unit 1 in the present embodiment is in cooperation with the second antenna unit 2, the feeding antenna unit 3, the first housing 10, and the second housing 20, but the present disclosure is not limited thereto. For example, in other embodiments of the present disclosure (not shown in the drawings), the first antenna unit 1 can be independently used (e.g., sold) or can be used in cooperation with other components. The following description describes the structure and connection relationship of each component of the antenna module 30.

Figure 4:
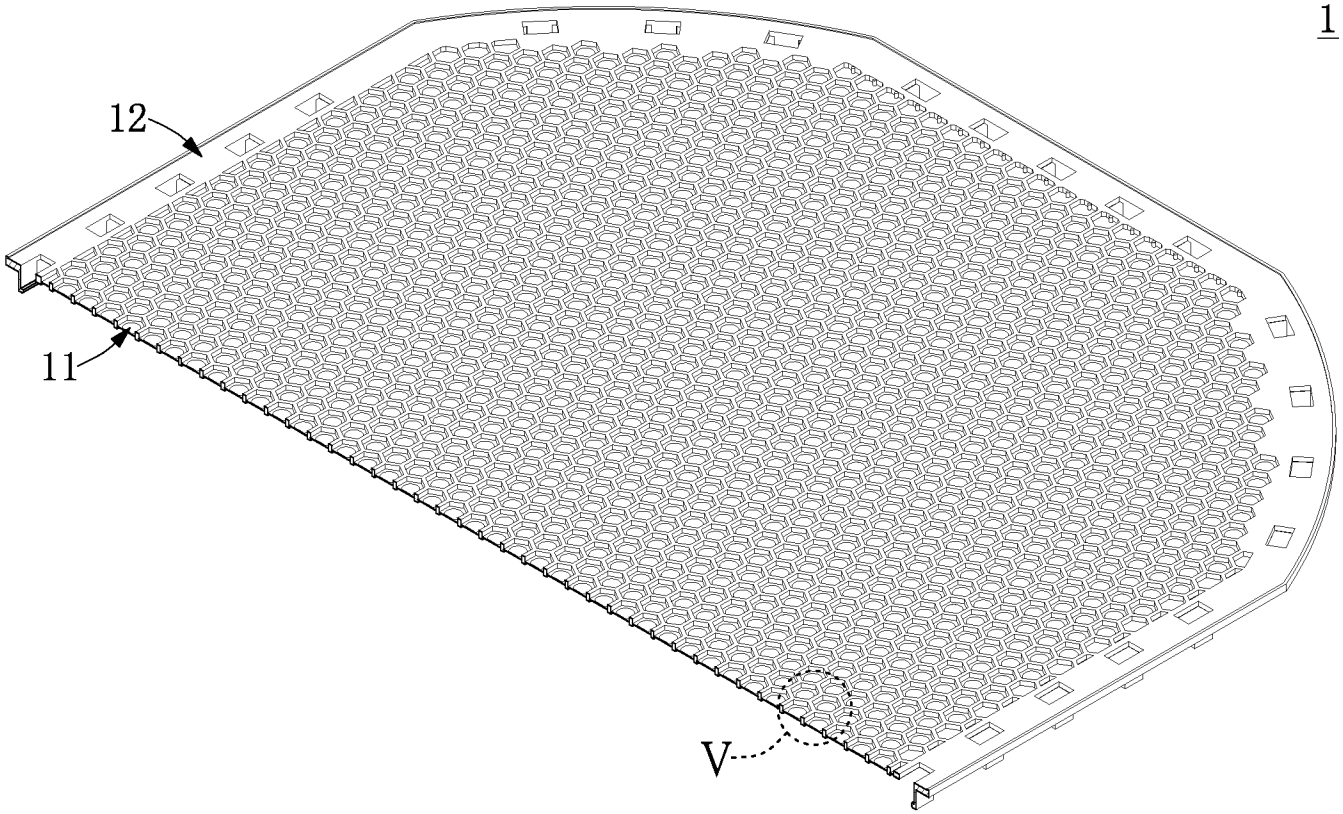
FIG. 4 is a perspective cross-sectional view showing a first antenna unit (or an antenna unit) of FIG. 2.
Figure 5:
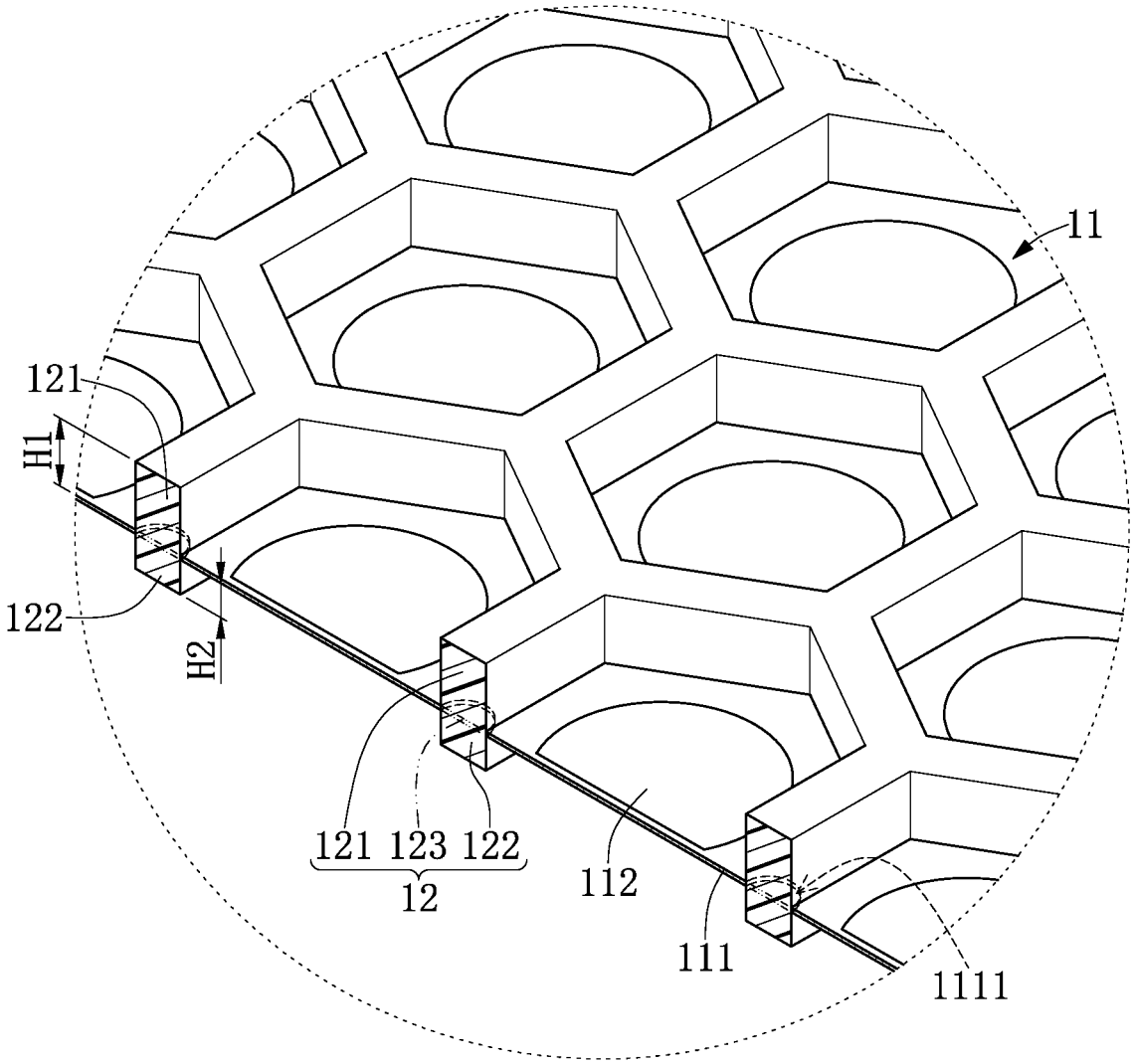
FIG. 5 shows an enlarged view of part V of FIG. 4.

As shown in FIG. 4 and FIG. 5, the first antenna unit 1 includes a first antenna structure 11 and a molding support 12 that is formed on the first antenna structure 11. In other words, the first antenna structure 11 and the molding support 12 in the present embodiment cannot be separate from each other.

The first antenna structure 11 includes a first substrate 111 and a plurality of first patches 112 that are formed on the first substrate 111. The first substrate 111 has a plurality of channel holes 1111 penetrating there-through, and any one of the channel holes 1111 in the present embodiment is substantially in a circular shape. The first patches 112 in the present embodiment are formed on an upper surface of the first substrate 111, and each of the first patches 112 is substantially in a circular shape, but the present disclosure is not limited thereto. For example, in other embodiments of the present disclosure (not shown in the drawings), the first patches 112 can be formed on the upper surface and/or a lower surface of the first substrate 111, and the shape of the channel hole 1111 and the shape of the first patch 112 can be adjusted or changed according to design requirements.

Figure 6:
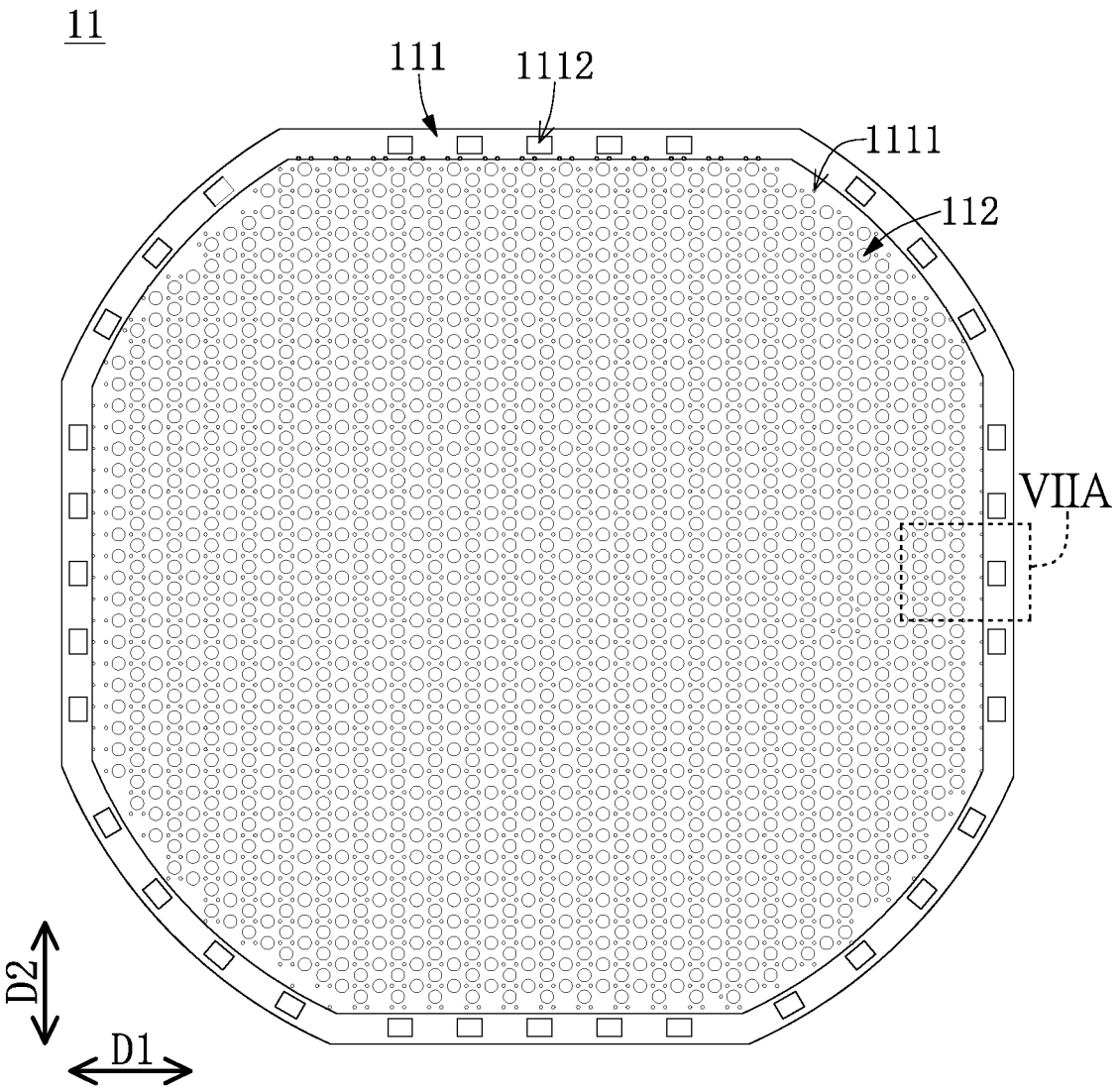
FIG. 6 is a top view of a first antenna structure (or an antenna structure) according to the first embodiment of the present disclosure.
Figure 7A:
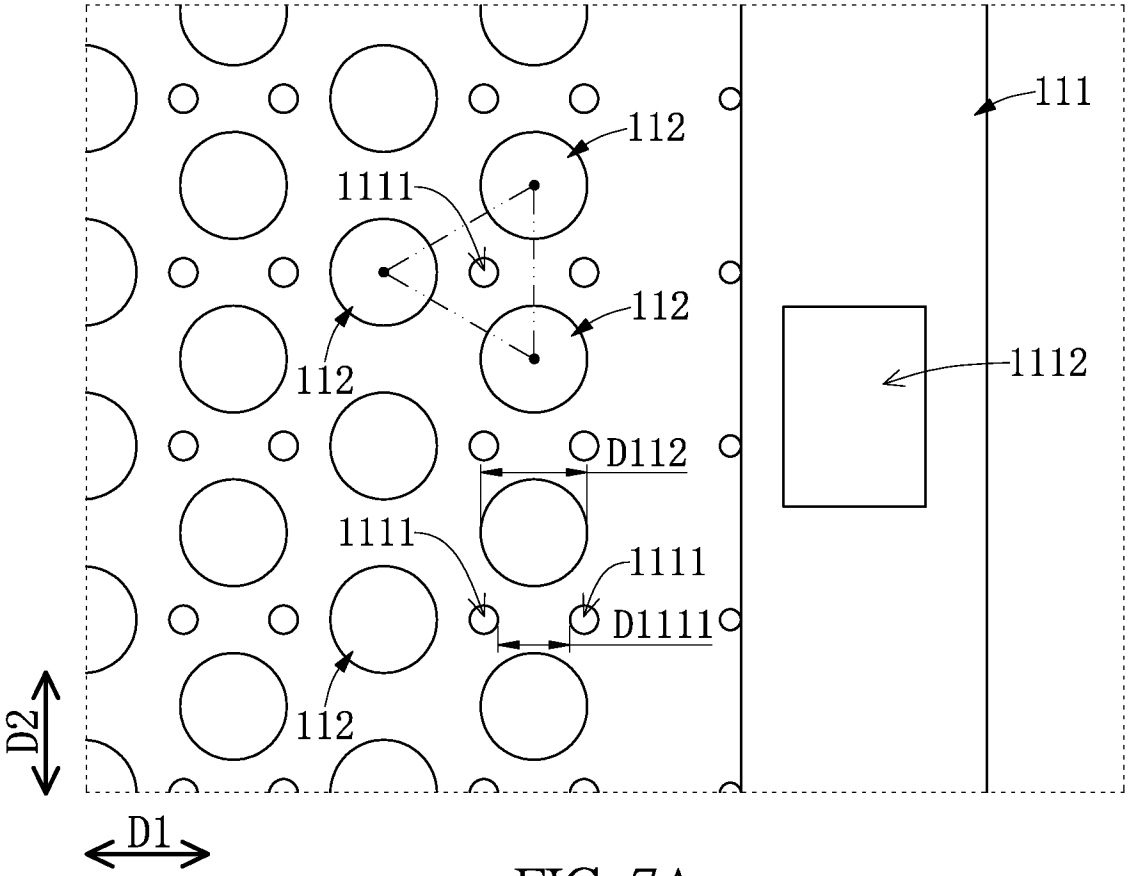
FIG. 7A shows an enlarged view of part VIIA of FIG. 6.

Specifically, as shown in FIG. 6 and FIG. 7A, the first patches 112 are arranged in a plurality of rows each parallel to a first direction D1, and the first patches 112 are also arranged in a plurality of columns each parallel to a second direction D2. The second direction D2 is perpendicular to the first direction D1. In the present embodiment, any two of the rows of the first patches 112 are not overlapped with each other along the second direction D2, and any two of the columns of the first patches 112 are partially overlapped with each other along the first direction D1, but the present disclosure is not limited thereto. For example, in other embodiments of the present disclosure (not shown in the drawings), any two of the columns of the first patches 112 can be not overlapped with each other along the first direction D1.

Moreover, the first antenna structure 11 preferably has at least one feature disclosed in the following description, so as to have a better structural strength and prevent distribution of the channel holes 1111 from affecting an operation of the first patches 112, but the present disclosure is not limited thereto.

As shown in FIG. 6 and FIG. 7A, a total area of the channel holes 1111 is less than or equal to a total area of the first patches 112, and an area of each of the channel holes 1111 is less than an area of any one of the first patches 112. A part (or some) of the channel holes 1111 and one of the rows of the first patches 112 are arranged in one row along the first direction D1. As shown in FIG. 7A, in the part of the channel holes 1111 and the one of the rows of the first patches 112, any two of the channel holes 1111 adjacent to each other have an interval D1111 there-between that is within a range from 5 mm to 10 mm and that is preferably less than or equal to a largest outer diameter D112 of any one of the first patches 112, and two of the first patches 112 arranged adjacent to each other along the first direction D1 are provided with two of the channel holes 1111 there-between. As shown in FIG. 7A, one of the channel holes 1111 is located at a centroid of a triangular shape defined by three of the first patches 112 that are arranged in two of the columns adjacent to each other.

Figure 7B:
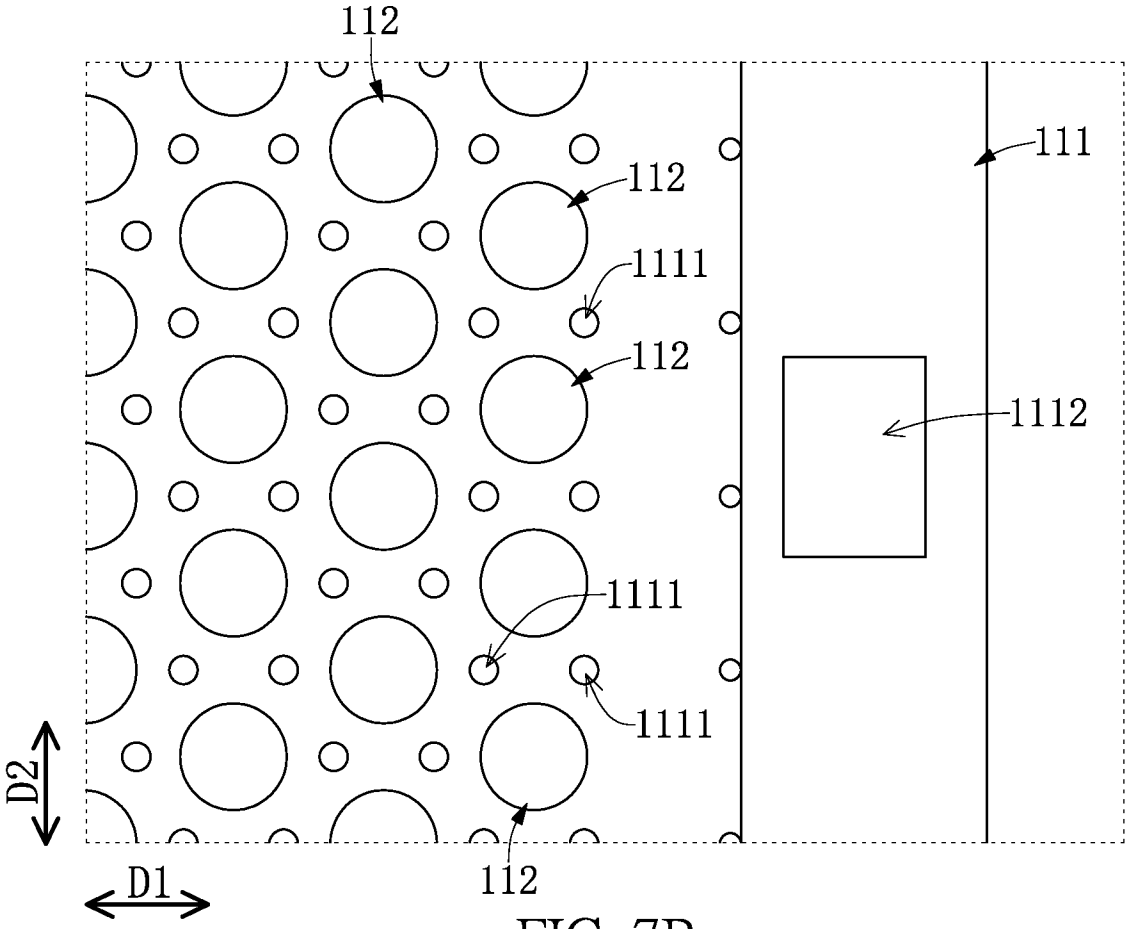
FIG. 7B is an enlarged view showing another configuration of FIG. 7A.

In addition, the distribution of the channel holes 1111 in the above description is arranged as shown in FIG. 7A, but can be adjusted or changed according to design requirements. For example, as shown in FIG. 7B, a quantity of the channel holes 1111 can be further increased based on the distribution of the channel holes 1111 shown in FIG. 7A.

As shown in FIG. 4 and FIG. 5, the molding support 12 is integrally formed on the first substrate 111 as a single one-piece structure. The molding support 12 has a first stand 121, a second stand 122, and a plurality of connection portions 123 that are formed in the channel holes 1111 to connect the first stand 121 and the second stand 122. Moreover, the first stand 121 and the second stand 122 are respectively formed on two sides of the first substrate 111 (e.g., the upper surface and the lower surface of the first substrate 111 shown in FIG. 4). It should be noted that the antenna module 30 in the present embodiment excludes any support (e.g., a riveting support or an engaging support) different from the molding support 12, so that the antenna module 30 can be assembled with a high precision.

The first stand 121 is formed on the upper surface of the first substrate 111 by a predetermined pattern, a peripheral edge of the first substrate 111 is covered by the first stand 121, and the first substrate 111 is substantially located in a space that is surroundingly defined by the first stand 121, so that the first antenna structure 11 can be protected by the first stand 121 from a direct collision with an external object.

Figure 8:
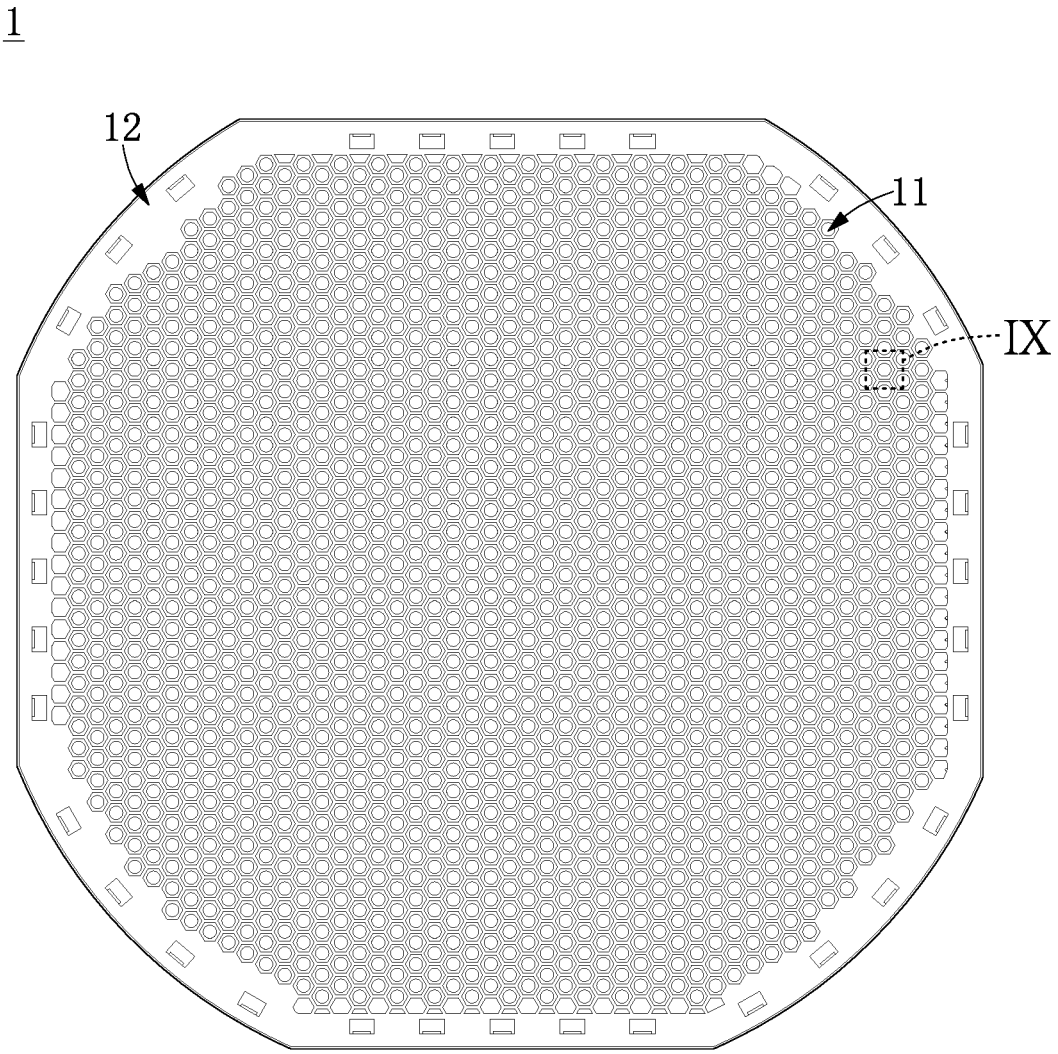
FIG. 8 is a top view showing the first antenna unit (or the antenna unit) of FIG. 2.
Figure 9:
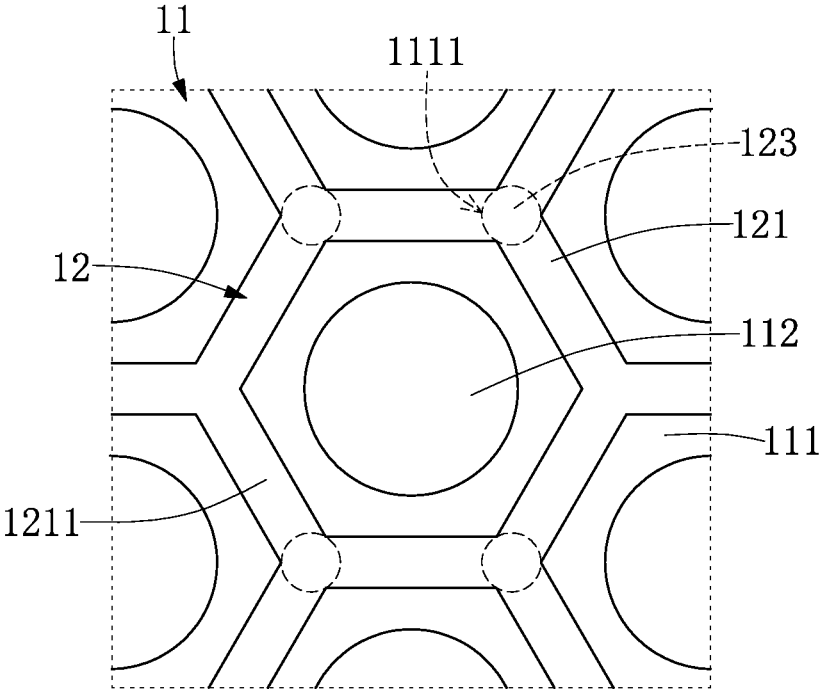
FIG. 9 shows an enlarged view of part IX of FIG. 8.

Moreover, as shown in FIG. 8 and FIG. 9, the first stand 121 includes a plurality of first partitions 1211 connected to each other. The first partitions 1211 are each gaplessly formed on the upper surface of the first substrate 111, and surround the first patches 112. In the present embodiment, a quantity of the first patches 112 surrounded by any one of the first partitions 1211 is less than or equal to four, and each of the first partitions 1211 is connected to at least one of the connection portions 123.

Specifically, each of the first partitions 1211 has a shape of a regular polygon having N number of sides, and N is a positive integer greater than three. Any two of the first partitions 1211 connected to each other share one side. In other words, one of the first partitions 1211 is at most connected to N number of the first partitions 1211. Moreover, at least half of corners of any one of the first partitions 1211 each are connected to one of the connection portions 123. In the present embodiment, N is six, four of the corners of any one of the first partitions 1211 are each connected to one of the connection portions 123, and a quantity of the first patches 112 surrounded by any one of the first partitions 1211 is one, but the present disclosure is not limited thereto. For example, in other embodiments of the present disclosure (not shown in the drawings), the shape of the first partition 1211 can be different from the regular polygon shape (e.g., can be a circular shape).

The second stand 122 includes a plurality of second partitions 1221 connected to each other. The second partitions 1221 are each gaplessly formed on the lower surface of the first substrate 111. In the present embodiment, a projection region defined by orthogonally projecting the second partitions 1221 onto the first stand 121 overlaps with the first partitions 1211.

In other words, a contour (or a cross section) of the first stand 121 in the present embodiment is substantially identical to a contour (or a cross section) of the second stand 122 (e.g., each of the second partitions 1221 is connected to at least one of the connection portions 123), so that the first stand 121 and the second stand 122 can have a better supporting effect along a direction perpendicular to the first substrate 111, thereby preventing the first antenna structure 11 from being damaged. Moreover, the first partitions 1211 and the second partitions 1221 can be firmly formed and connected to each other through the connection portions 123.

In addition, any one of the first partitions 1211 has a first height H1 relative to the first substrate 111 (e.g., the upper surface), any one of the second partitions 1221 has a second height H2 relative to the first substrate 111 (e.g., the lower surface), and the second height H2 is less than or equal to the first height H1.

According to the above, the first antenna unit 1 in the present embodiment is provided with the channel holes 1111 that are formed in the first substrate 111 to receive the connection portions 123, so that the first stand 121 and the second stand 122 can be firmly formed on the two sides of the first substrate 111 by the connection portions 123 arranged in the channel holes 1111, thereby reducing a quantity of components to be assembled in the antenna array device 100. Accordingly, a production process of the antenna array device 100 can be shortened, and tolerance accumulation generated from assembling the components of the antenna array device 100 can be effectively reduced.

Figure 12A:
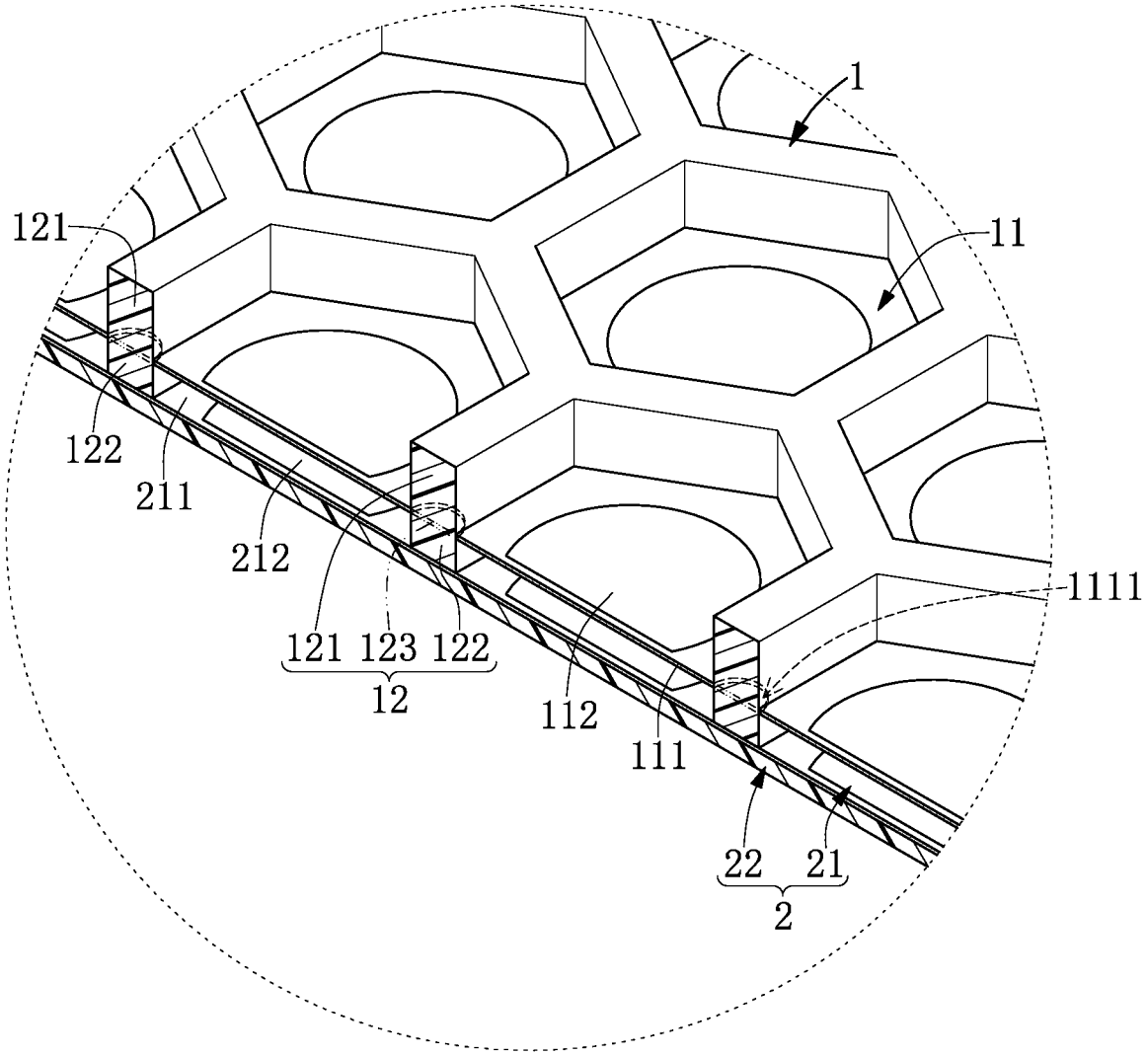
FIG. 12A is a partial cross-sectional view of the first antenna structure and a second antenna structure according to the first embodiment of the present disclosure.

As shown in FIG. 2, FIG. 3, and FIG. 12A, the second antenna unit 2 includes a second antenna structure 21 and a spacer 22. The second antenna structure 21 is located between the second stand 122 and the spacer 22. In other words, the first stand 121 faces toward the first housing 10, and the second stand 122 faces toward the second antenna structure 21 of the second antenna unit 2.

Figure 12B:
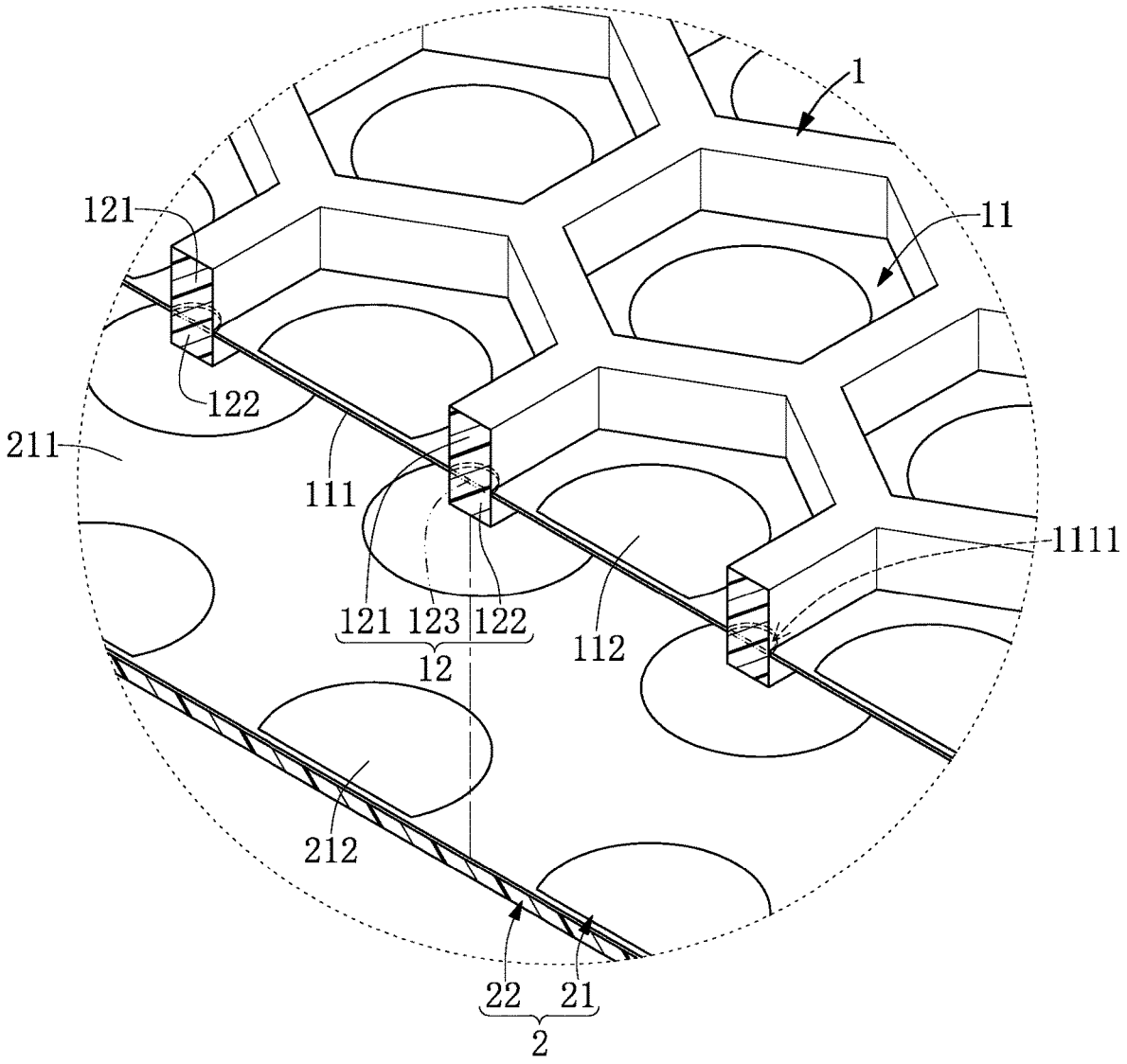
FIG. 12B is an exploded view of FIG. 12A.

The second antenna structure 21 in the present embodiment is similar to the first antenna structure 11. For example, as shown in FIG. 12A and FIG. 12B, the second antenna structure 21 includes a second substrate 211 and a plurality of second patches 212 that are formed on the second substrate 211 and that respectively correspond in position to the first patches 112 along a height direction H. Accordingly, any one of the second patches 212 can couple to a corresponding one of the first patches 112.

Moreover, as shown in FIG. 3 and FIG. 12A, the second antenna structure 21 is connected to (or adhered to) the second stand 122, and the spacer 22 is connected to (or adhered to) the second antenna structure 21 (e.g., the second substrate 211) and the feeding antenna unit 3, but the present disclosure is not limited thereto. For example, in other embodiments of the present disclosure (not shown in the drawings), the spacer 22 can be integrally formed on the second antenna structure 21 as a single one-piece structure, and the second antenna structure 21 can be different from the first antenna structure 11.

Figure 14:
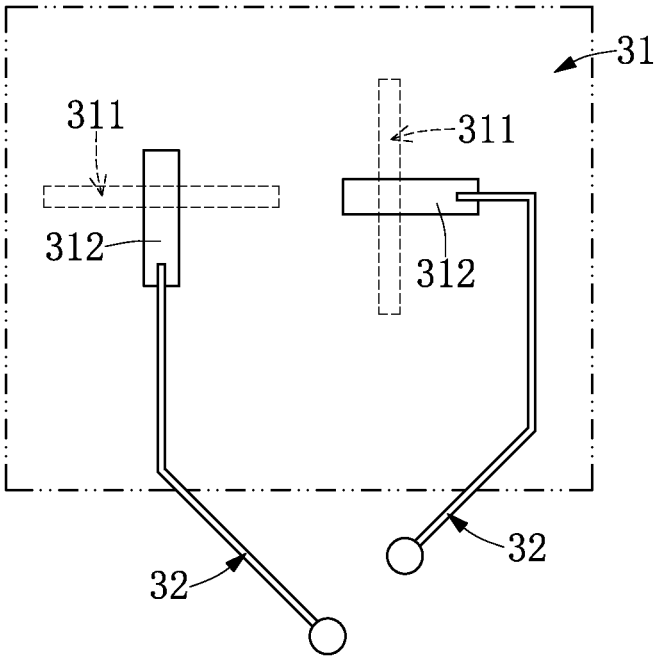
FIG. 14 is a schematic view of a feeding antenna unit according to the first embodiment of the present disclosure.

As shown in FIG. 2, FIG. 3, and FIG. 14, the feeding antenna unit 3 is located between the second housing 20 and the spacer 22, and is configured to couple to the second antenna structure 21. In the present embodiment, the feeding antenna unit 3 includes a circuit board 31 and at least one feeding cable 32 that is connected to the circuit board 31. The circuit board 31 has at least one antenna 311 having a slot (e.g., a slot antenna) arranged adjacent to the second antenna structure 21 and at least one radiating portion 312 that is configured to couple to the at least one antenna 311. The at least one antenna 311 is configured to couple to the second antenna structure 21. The slot antenna 311 is excited by the at least one radiating portion 312 which is connected to and fed by the at least one feeding cable 32, and the second antenna structure 21 can be further configured to couple to the first antenna structure 11. In another embodiment, the antenna 311 may be a patch which is connected to the feeding cable 32.

Figure 10:
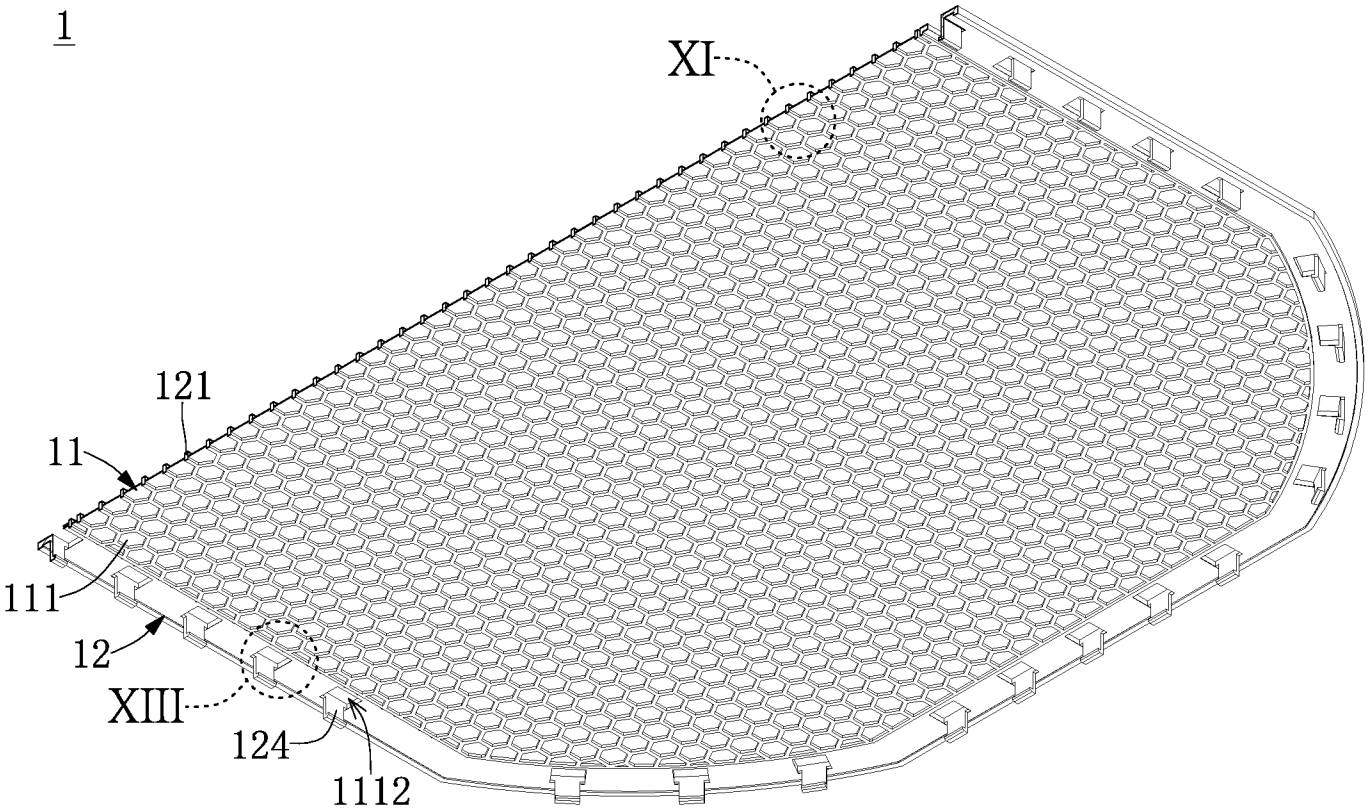
FIG. 10 is a perspective cross-sectional view showing the first antenna unit (or the antenna unit) of FIG. 2 from another angle of view.
Figure 11:
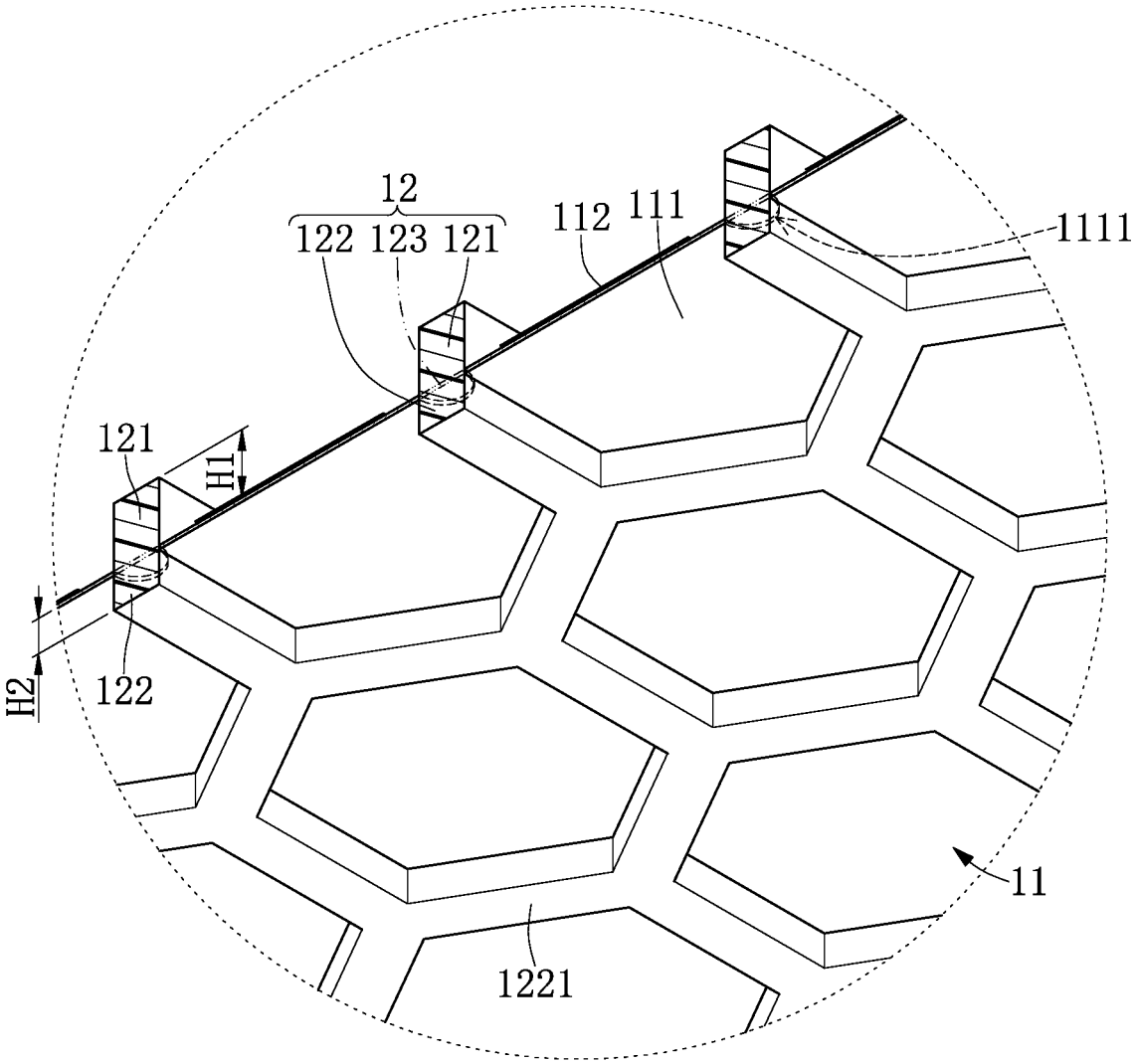
FIG. 11 shows an enlarged view of part XI of FIG. 10.
Figure 13:
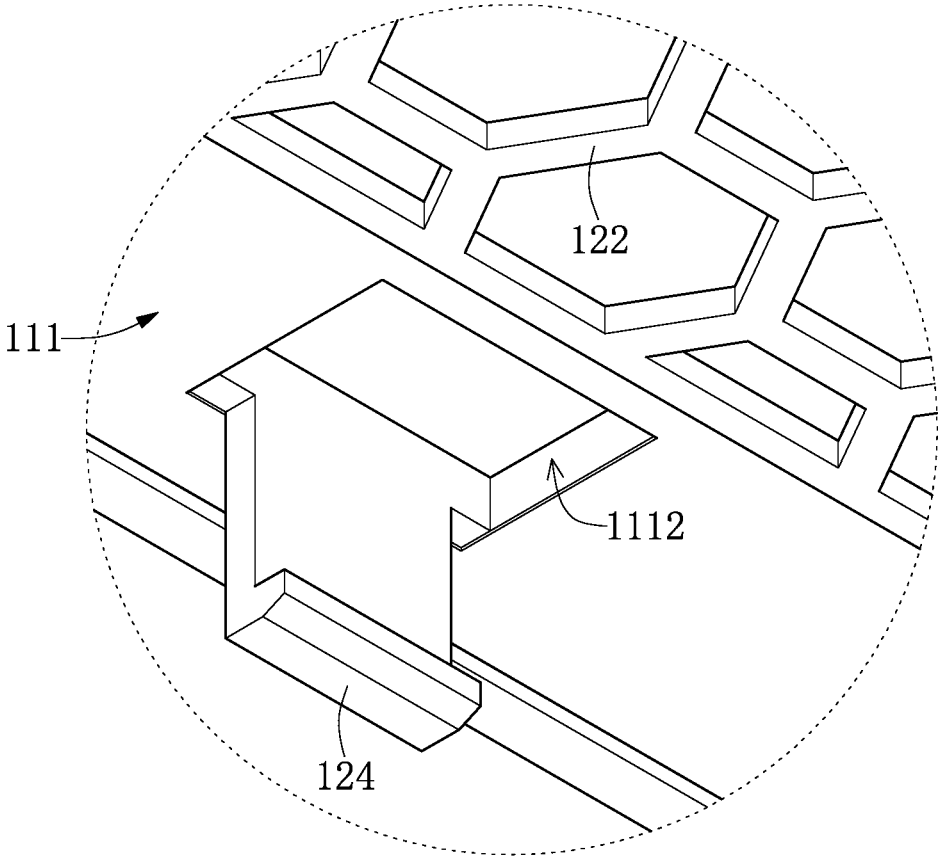
FIG. 13 shows an enlarged view of part XIII of FIG. 10.

As shown in FIG. 10 and FIG. 13, the first substrate 11 in the present embodiment has a plurality of thru-holes 1112 that are distributed outside of the first patches 112 and that are arranged along the peripheral edge of the first substrate 111, and the molding support 12 includes a plurality of engaging arms 124 extending from the first stand 121 and respectively passing through the thru-holes 1112, so that the first antenna structure 11 can be assembled to other components through the thru-holes 1112 and the engaging arms 124, but the present disclosure is not limited thereto. For example, in other embodiments of the present disclosure (not shown in the drawings), the first substrate 111 can be provided without any thru-hole 1112, and the molding support 12 can be provided without any engaging arm 124.

Second Embodiment

Figure 15:
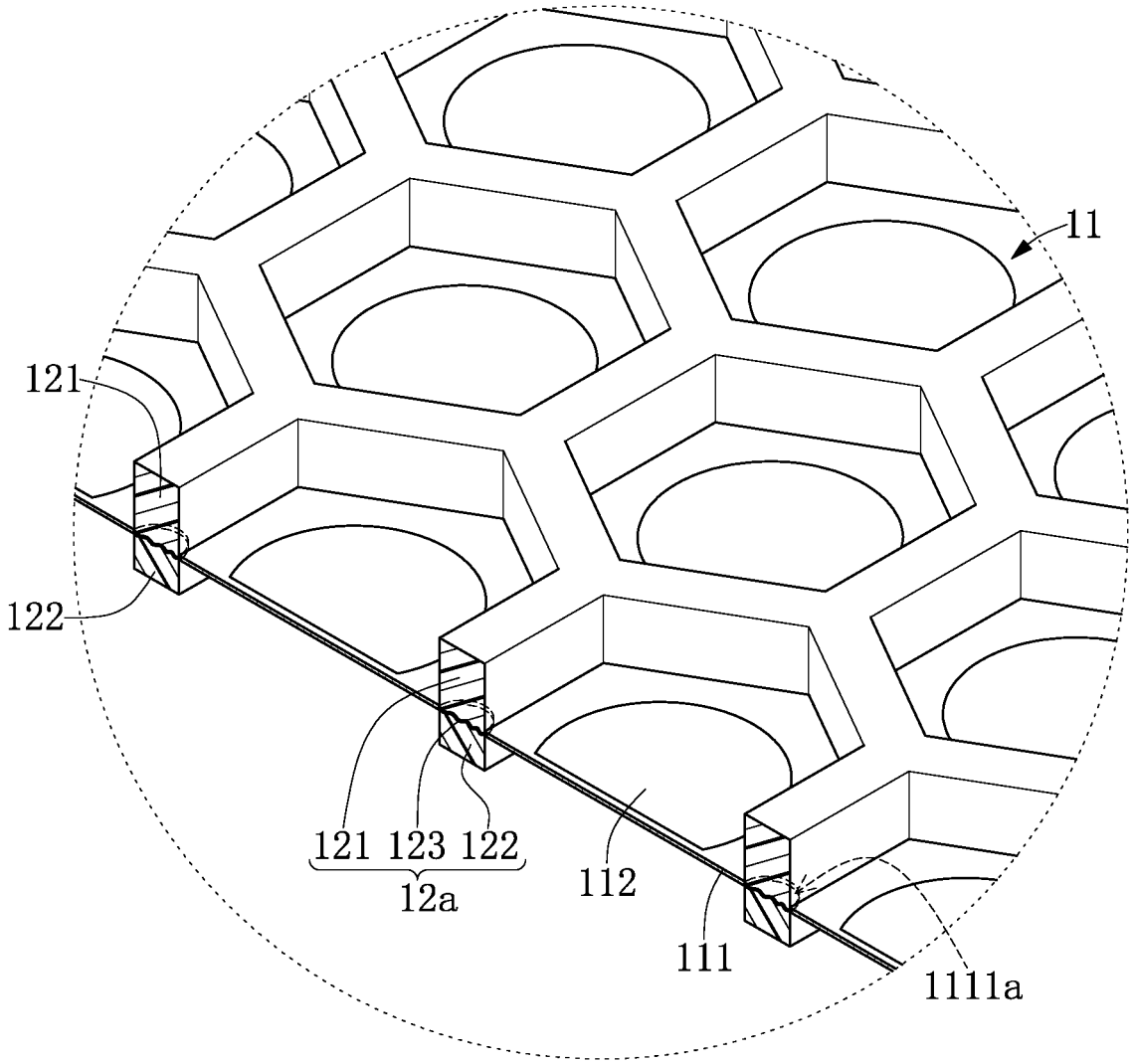
FIG. 15 is a partial cross-sectional view of the first antenna structure according to a second embodiment of the present disclosure.

Referring to FIG. 15, a second embodiment of the present disclosure is provided, which is similar to the first embodiment of the present disclosure. For the sake of brevity, descriptions of the same components in the first and second embodiments of the present disclosure will be omitted herein, and the following description only discloses different features between the first and second embodiments.

In the present embodiment, the channel hole 1111 disclosed in the first embodiment is renamed as a penetrating hole 1111*a*, and the molding support 12 disclosed in the first embodiment is replaced by a support 12*a*. The support 12*a* includes a first stand 121, a second stand 122, and a plurality of connection portions 123 that are arranged in the penetrating holes 1111*a* to connect the first stand 121 and the second stand 122. The first stand 121 and the second stand 122 are respectively disposed on two sides of the first substrate 111.

Specifically, at least one of the first stand 121 and the second stand 122 is a light-permeable structure that can allow a laser light to pass there-through and to travel onto portions of the first stand 121 and the second stand 122 arranged in the penetrating holes 1111*a*, thereby connecting the portions of the first stand 121 and the second stand 122 in the penetrating holes 1111*a*. In the present embodiment, a connection interface between the first stand 121 and the second stand 122 in any one of the penetrating holes 1111*a* is defined as one of the connection portions 123.

BENEFICIAL EFFECTS OF THE EMBODIMENTS

In conclusion, the antenna unit (e.g., the first antenna unit) in the present disclosure is provided with the penetrating holes (e.g., the channel holes) that are formed in the first substrate to receive the connection portions, so that the first stand and the second stand can be firmly formed on the two sides of the first substrate by the connection portions arranged in the penetrating holes (e.g., the channel holes), thereby reducing a quantity of components to be assembled in the antenna array device. Accordingly, a production schedule of the antenna array device can be shortened, and tolerance accumulation generated from assembling the components of the antenna array device can be effectively reduced.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna array device, comprising:

a first housing and a second housing that are connected to each other so as to jointly define a distribution space; and an antenna module located in the distribution space and including:

a first antenna unit including:

a first antenna structure including a first substrate and a plurality of first patches that are formed on the first substrate, wherein the first substrate has a plurality of channel holes penetrating there-through; and a molding support integrally formed on the first substrate as a single one-piece structure, wherein the molding support has a first stand, a second stand, and a plurality of connection portions that are formed in the channel holes to connect the first stand and the second stand, and wherein the first stand and the second stand are formed on two sides of the first substrate, respectively, and the first stand faces toward the first housing;

a second antenna unit including a second antenna structure and a spacer, wherein the second antenna structure is located between the second stand and the spacer; and a feeding antenna unit being located between the second housing and the spacer and being configured to couple to the second antenna structure.

2. The antenna array device according to claim 1, wherein the first stand includes a plurality of first partitions surrounding the first patches, and wherein a quantity of the first patches surrounded by any one of the first partitions is less than or equal to four.

3. The antenna array device according to claim 1, wherein the first stand includes a plurality of first partitions surrounding the first patches, and wherein a quantity of the first patches surrounded by any one of the first partitions is one.

4. The antenna array device according to claim 3, wherein each of the first partitions has a shape of a regular polygon having N number of sides, and N is a positive integer greater than three, and wherein at least half of corners of any one of the first partitions each are connected to one of the connection portions.

5. The antenna array device according to claim 1, wherein the first stand includes a plurality of first partitions surrounding the first patches, and wherein each of the first partitions is connected to at least one of the connection portions.

6. The antenna array device according to claim 1, wherein the first stand includes a plurality of first partitions surrounding the first patches, and the second stand includes a plurality of second partitions, and wherein a projection region defined by orthogonally projecting the second partitions onto the first stand overlaps with the first partitions.

7. The antenna array device according to claim 6, wherein any one of the first partitions has a first height relative to the first substrate, any one of the second partitions has a second height relative to the first substrate, and the second height is less than the first height.

8. The antenna array device according to claim 1, wherein the first patches are arranged in a plurality of rows each parallel to a first direction, and a part of the channel holes and one of the rows of the first patches are arranged in one row along the first direction.

9. The antenna array device according to claim 8, wherein the first patches are arranged in a plurality of columns each parallel to a second direction, and the second direction is perpendicular to the first direction, and wherein one of the channel holes is located at a centroid of a triangular shape defined by three of the first patches that are arranged in two of the columns adjacent to each other.

10. The antenna array device according to claim 1, wherein any two of the channel holes adjacent to each other have an interval there-between that is within a range from 5 mm to 10 mm.

11. The antenna array device according to claim 1, wherein a total area of the channel holes is less than a total area of the first patches.

12. The antenna array device according to claim 1, wherein the feeding antenna unit includes a circuit board having at least one antenna arranged adjacent to the second antenna structure, and wherein the at least one antenna is configured to couple to the second antenna structure, and the second antenna structure is configured to couple to the first antenna structure.

13. The antenna array device according to claim 1, wherein the feeding antenna unit further includes at least one feeding cable, and the circuit board further includes at least one radiating portion that is connected to the at least one feeding cable, and wherein the at least one radiating portion is configured to couple to the at least one antenna having a slot, and the at least one antenna is configured to couple to the second antenna structure.

14. The antenna array device according to claim 1, wherein the second antenna structure is connected to the second stand, and the spacer is connected to the second antenna structure and the feeding antenna unit, and wherein the second antenna structure includes a second substrate and a plurality of second patches that are formed on the second substrate and that respectively correspond in position to the first patches.

15. An antenna unit of an antenna array device, comprising:

an antenna structure including a substrate and a plurality of patches that are formed on the substrate, wherein the substrate has a plurality of channel holes penetrating there-through; and a molding support integrally formed on the substrate as a single one-piece structure, wherein the molding support has a first stand, a second stand, and a plurality of connection portions that are formed in the channel holes to connect the first stand and the second stand, and wherein the first stand and the second stand are formed on two sides of the substrate, respectively.

16. The antenna unit according to claim 15, wherein the patches are arranged in a plurality of rows each parallel to a first direction, and a part of the channel holes and one of the rows of the patches are arranged in one row along the first direction.

17. The antenna unit according to claim 16, wherein the patches are arranged in a plurality of columns each parallel to a second direction that is perpendicular to the first direction, and one of the channel holes is located at a centroid of a triangular shape defined by three of the patches that are arranged in two of the columns adjacent to each other.

18. The antenna unit according to claim 15, wherein the first stand includes a plurality of first partitions surrounding the patches, wherein each of the first partitions has a shape of a regular polygon having N number of sides, and N is a positive integer greater than three, and wherein at least half of corners of any one of the first partitions each are connected to one of the connection portions.

19. The antenna unit according to claim 18, wherein the second stand includes a plurality of second partitions, and wherein a projection region defined by orthogonally projecting the second partitions onto the first stand overlaps with the first partitions.

* * * * *